US010611448B2

(12) United States Patent
Taylor

(10) Patent No.: US 10,611,448 B2
(45) Date of Patent: Apr. 7, 2020

(54) HIGH-PERFORMANCE PROP GUARD

(71) Applicant: Guy Taylor, Duchesne, UT (US)

(72) Inventor: Guy Taylor, Duchesne, UT (US)

(73) Assignee: 3PO BOAT ACCESSORIES, LLC, Duchesne, UT (US)

( * ) Notice: Subject to any disclaimer, the term of this patent is extended or adjusted under 35 U.S.C. 154(b) by 0 days.

(21) Appl. No.: 16/028,213

(22) Filed: Jul. 5, 2018

(65) Prior Publication Data

US 2020/0010163 A1 Jan. 9, 2020

(51) Int. Cl.

| | |
|---|---|
| ***B63H 5/14*** | (2006.01) |
| ***B63H 5/16*** | (2006.01) |
| ***B63H 20/32*** | (2006.01) |

(52) U.S. Cl.

CPC ..... *B63H 5/165* (2013.01); *B63H 20/32* (2013.01); *B63H 5/14* (2013.01)

(58) Field of Classification Search

CPC . B63H 5/165; B63H 5/14; B63H 5/15; B63H 20/32

See application file for complete search history.

(56) References Cited

U.S. PATENT DOCUMENTS 5,098,321 A * 3/1992 Taylor, Jr. ..... B63H 5/14 440/67

5,928,042 A * 7/1999 Quiggins ..... B63H 5/165 416/247 A

* cited by examiner

*Primary Examiner* — Stephen P Avila

(74) *Attorney, Agent, or Firm* — Kirton McConkie; Evan R. Witt

(57) ABSTRACT

A propeller guard including inner circumferential component defining a multi-angled band formed of a plurality of independently radiused sections and an outer fluid amplifier extending along sides of the inner circumferential component. The band may also include a plurality of evenly spaced ports therethrough. The propeller guard is designed to improve the performance characteristics, specifically acceleration, planing, speed and steering, of the motor. The outer fluid amplifier increases flow of fluid through the ports of the inner circumferential component and further improves performance characteristics of the boat and motor to which the propeller guard is attached.

17 Claims, 10 Drawing Sheets

HIGH-PERFORMANCE PROP GUARD

BACKGROUND OF THE INVENTION

1. Field of the Invention

The present invention relates generally to guard members for shielding the propeller of an outboard motor. More specifically, the present invention relates to a propeller guard which is designed for maximizing the performance characteristics of an outboard motor.

2. Background and Related Art

The propeller of an outboard motor typically rests below the bottom surface of the boat when in use, and propels the boat through the water. Due to its position during operation, the propeller tends to be very susceptible to damage from underwater objects such as rocks, sandbars, marine life and the like. If the propeller becomes damaged due to its impingement on underwater objects, it may become unable to perform as designed. The need for repair and/or replacement of a propeller damaged thus generally occurs at very inconvenient times and is always very expensive. Therefore, a need exists to develop a guard which can protect the propeller of an outboard motor and prevent its being damaged by underwater objects.

Also, the propeller of an outboard motor spins at an extremely high RPM during use. Should a passenger, skier, swimmer or other person be accidentally hit by the propeller during operation of the motor, serious injury will inevitably result. Unshielded boat propellers have been known to injure marine life. Therefore, a guard which will inhibit accidental contact of a person or marine life with the propeller to prevent accidental bodily injury is also needed.

Many prior-art attempts have been made to solve the above problems. Several prior-art devices which are representative of the many previous attempts to develop a prop guard responding to the above-identified needs are shown in U.S. Pat. No. 2,551,371 to Grieg; U.S. Pat. No. 2,963,000 to Fester; U.S. Pat. No. 2,983,246 to Manley; and, U.S. Pat. No. 4,078,516 to Balius. In each of these devices, an enclosure, generally including a hollow cylindrical member, is attached to the outboard motor so as to surround the propeller. The devices are designed to allow water to have fluid flow access to the propeller in order to allow the propeller to function as designed. Although these devices are somewhat successful in preventing damage to the propeller by preventing contact of the propeller with underwater objects, several severe drawbacks nevertheless remain. Most importantly, each of these devices tends to severely reduce the performance characteristics of the outboard motor.

As is well understood, an outboard motor pushes a boat forward in reaction to the propeller or propellers of the motor forcing water backwards. However, an outboard motor which also includes a propeller guard is inhibited in its performance due to the fact that water flowing past the propeller tends to be blocked or directed away from the propeller by the guard. Also, water impinging on the guard during operation of the motor increases the drag characteristic thereof, thus decreasing performance. Further, the presence of the guard, since not necessarily designed as an integral part of the motor, can cause instability, vibrations, control degradation, and unpredictability of motor response during use. Finally, prior-art propeller guards are attached to the motor in such a manner as to be incapable of preventing damage or failure of the attachment members during high-speed use. Accordingly, it is needful that a propeller guard be developed and designed which affords protection against contact between the propeller and underwater objects, and which at the same time is designed so as to maintain or improve motor performance characteristics such as steering, top end speed, planing, acceleration, and durability.

U.S. Pat. No. 4,680,017 to Eller attempts to address the problem of maintaining and/or improving performance characteristics of the motor through the design of a propeller guard. The propeller guard of the Eller invention functions to prevent radial dissipation of water passing through the propeller, to thereby cause all water to be directed in a linearly rearward direction as it passes the propeller. The intent is to ensure that all the water passing through the guard is useful in generating forward motion of the boat. However, in operation, the drag characteristics of Eller's propeller guard tend to off-set any advantages of its use. Further, control characteristics of Eller's motor are significantly degraded due to the presence and design of Eller's propeller guard.

U.S. Pat. No. 5,098,321 to Taylor, Jr., inventor of the present application, also attempts to address the problem of maintaining and/or improving performance characteristics of the motor through the design of a propeller guard. The Taylor, Jr. invention includes many improvements over prior propeller guards in this respect including the use of a series of evenly spaced openings around the ring portion of the guard which are formed to allow water to pass therethrough during operation so as to increase the water volume passing the propeller and to avoid cavitation during turning. U.S. Pat. No. 6,159,062, also to Taylor, Jr. builds upon the design features in the '321 Taylor, Jr. patent to further improve fluid flow past the propeller. Increased water pressure at the propeller plate surfaces, prevents cavitation due to the presence of the propeller guard, and improves steering, top end speed, planing, acceleration, and durability of the motor.

BRIEF SUMMARY OF THE INVENTION

It is a principle object of the present invention to provide a propeller guard for an outboard motor which is designed to maintain or improve the performance characteristics of the motor.

It is also a principle object of the present invention to provide a propeller guard for an outboard motor which can prevent inadvertent contact of underwater objects with the motor propeller during use.

It is another object of the present invention to provide a propeller guard which improves the control characteristics such as planing, top speed, acceleration, steering, and durability of the outboard motor.

It is further an object of the present invention to design a propeller guard which is simple to manufacture and therefore relatively inexpensive, yet durable and reliable in use.

These and other objects of the present invention are realized in a specific embodiment of a propeller guard, described herein by way of example and not limitation, which includes an inner circumferential component defining a band forming a circumference around the motor propeller over which it is attached. The band may include a small concave attachment plate at one position thereabout and an attachment bracket diametrically opposed thereto. The attachment plate and bracket allow the band to be securely attached to the outboard motor at the bottom of the motor's anti-ventilation fin and at the bottom end of the motor's lower fin respectively.

The circumference of the band may be formed in a series of sections having alternating radius lengths, including infinitely radiused (completely flat) sections if desired, which function to diminish the band's drag and vibration characteristics while at the same time channeling fluid toward the propeller at all steering positions thereof, to increase fluid pressure of the propeller, reduce or eliminate cavitation, and thus improve the performance characteristics of the motor. The band is secured to the motor with the aid of an attachment bracket which may be designed to minimize vibrations and other cyclical loading thereon in order to prevent premature metal fatigue, cracking, or failure.

An outer fluid amplifier is affixed to the inner circumferential component and defines one or more fluid channels extending along an exterior surface of the band. The outer fluid amplifier may be formed as two fluid amplifier members, each extending out from and along a respective side of the inner circumferential component to define a fluid channel along the respective side. The fluid amplifier members may be rotated with respect to the exterior surface of the band such that the fluid channels extending along the exterior surface of the band are wider proximate an inlet side of the propeller guard and narrower proximate an outlet side of the propeller guard, such that fluid entering the fluid channels is compressed as the propeller guard passes through the fluid. The higher pressure of the fluid in the fluid channels forces fluid through a series of ports formed through the band.

In some embodiments of the propeller guard, the band is formed with a convex taper on the interior side of its inlet opening and a similar convex tapper on the exterior side of its outlet opening. The band may also include a series of ports positioned around the circumference thereof. The ports allow the water passing over the band's exterior surface to be diverted, by vacuum force, toward the propeller as the band passes through the water. This diversion is further accentuated by the increased pressure of the water in the fluid channels external to the band of the inner circumferential component. Water passing over the interior surface of the band is accelerated due to the convex ("wing-like") shape of the inlet opening thereof, and causes a vacuum like effect through the ports which pulls water through the ports (from the exterior of the ring to the interior thereof) as the guard passes through the water. This diversion of water is further accentuated by the increased pressure of the water in the fluid channels external to the band of the inner circumferential component. The ports are preferably oriented around the band in a generally uniform manner and formed through the band in a manner which causes the water passing therethrough to be given a slight radial component of flow. The size, number and general distribution of the ports about the band are calculated to cause a sufficient radial flow of water to increase control and steerability of the motor. At the same time, the port placement is also predetermined to avoid cavitation during a sharp turn which may be caused by water flow blockage by the band when the band moves into the flow path of the water passing the motor.

According to certain implementations of a propeller guard useful in combination with a boat motor, the propeller guard includes an inner circumferential component defining a single band for surrounding a propeller of the motor, the band including an interior surface and an exterior surface and defining a single inlet opening and a single outlet opening and an outer fluid amplifier extending from the inner circumferential component and defining a fluid channel extending along a side of the inner circumferential component. The outer fluid amplifier may include a first amplifier member extending from a first point of the band of the inner circumferential component to a second point of the band of the inner circumferential component to define a first fluid channel extending along a first side of the inner circumferential component and a second amplifier member extending from a third point of the band of the inner circumferential component to a fourth point of the band of the inner circumferential component to define a second fluid channel extending along a second side of the inner circumferential component.

The band may include a plurality of ports formed therein and spaced there around, the plurality of ports allowing fluid flow between the exterior and interior surfaces of the band. The band may include a convex tapered portion on the interior surface proximate the inlet opening whereby movement of the propeller guard through a fluid such that fluid enters the inlet opening and exits the outlet opening thereof, causes fluid impinging on a convex tapered portion of the interior surface to be diverted along the interior surface and to be accelerated in speed relative to fluid flowing along the exterior surface, thus causing a vacuum effect which draws fluid through the plurality of ports into the band.

The first amplifier member and the second amplifier member may each define an inner surface that is rotated relative to the exterior surface of the band such that the first fluid channel and the second fluid channel are wider proximate the inlet opening and narrower proximate the outlet opening, whereby movement of the propeller guard through a fluid such that fluid enters the first fluid channel and the second fluid channel causes compression of the fluid in the first fluid channel and the second fluid channel, increasing flow of fluid through at least a portion of the plurality of ports having openings located in the first fluid channel or the second fluid channel.

The band of the inner circumferential component may define a multi-angle shape and the first amplifier member and the second amplifier member may each have a complementary shape generally conforming to an adjacent portion of the band of the inner circumferential component such that the first fluid channel and the second fluid channel each define an elongated narrow channel extending along a side of the inner circumferential component.

The first point of the band and the third point of the band may be opposite ends of a first side of the band, and the second point of the band and the fourth point of the band may be opposite ends of a second side of the band, the second side of the band and the first side of the band being opposite, substantially parallel sides of the band. A third side of the band between the first point of the band and the second point of the band may have an infinite radius and be generally flat. A section of the first amplifier member most proximate to the third side of the band may also have an infinite radius and be generally flat. A fourth side of the band between the third point of the band and the fourth point of the band may have an infinite radius and be generally flat. A section of the second amplifier member most proximate to the fourth side of the band may also have an infinite radius and be generally flat.

A fifth side of the band may extend between the first side of the band and the third side of the band. A sixth side of the band may extend between the second side of the band and the third side of the band. A seventh side of the band may extend between the first side of the band and the fourth side of the band. An eighth side of the band may extend between the second side of the band and the fourth side of the band. The fifth, sixth, seventh, and eighth sides of the band may all have a curved shape. Two sections of the first amplifier member extending proximate the fifth and sixth sides of the band may have a curved shape similar to the curved shape of the fifth and sixth sides. Two sections of the second amplifier member extending proximate the seventh and eighth sides of the band may have a curved shape similar to the curved shape of the seventh and eighth sides.

The band of the inner circumferential component may define an eight-sided shape with generally flat top and bottom sections adapted to be secured to a motor, two generally flat side sections, and four radiused or curved sections, each extending between one of the top or bottom sections to one of the side sections. The first amplifier member may extend from the band proximate an end of the top section of the band to an end on a same side of the bottom section of the band, and the first amplifier member may include two curved sections and a generally flat section each extending alongside corresponding curved and flat sections of the band of the inner circumferential component. The second amplifier member may extend from the band proximate an opposite end of the top section of the band to an end of the bottom section of the band opposite the end intersecting the first amplifier member, and the second amplifier member may include two curved sections and a generally flat section each extending alongside corresponding curved and flat sections of the band of the inner circumferential component.

The sections of the inner circumferential member may be of approximately equal size. The inlet opening and leading edges of the first amplifier member and the second amplifier member may be generally planar. Alternatively, at least one of the inlet opening, a leading edge of the first amplifier member, or a leading edge of the second amplifier member define a sinusoidal shape.

According to further implementations of a propeller guard useful in combination with a boat motor, the propeller guard includes an inner circumferential component defining a multi-angled band for surrounding a propeller of the motor, the band including an interior surface and an exterior surface and defining an inlet opening and an outlet opening, the band further defining a plurality of sections and an outer fluid amplifier that includes a first amplifier member extending from the inner circumferential component and defining a first fluid channel extending along a first exterior side of the inner circumferential component and a second amplifier member extending from the inner circumferential component and defining a second fluid channel extending along a second exterior side of the inner circumferential component.

The band may include a plurality of ports formed therein and spaced there around, the plurality of ports allowing fluid flow between the exterior and interior surfaces of the band. The first amplifier member and the second amplifier member may each define an inner surface that is rotated relative to the exterior surface of the band such that the first fluid channel and the second fluid channel are wider proximate the inlet opening and narrower proximate the outlet opening, whereby movement of the propeller guard through a fluid such that fluid enters the first fluid channel and the second fluid channel causes compression of the fluid in the first fluid channel and the second fluid channel, increasing flow of fluid through at least a portion of the plurality of ports having openings located in the first fluid channel or the second fluid channel.

The first amplifier member and the second amplifier member may each have a shape generally conforming to an adjacent portion of the band of the inner circumferential component. The band may have eight sections generally defining an eight-sided shape with alternating generally flat and curved sides including a generally flat top side and a generally flat bottom side. The first amplifier member may extend from one end of the top side of the band to one end of the bottom side of the band and may be formed with a first curved section, a generally flat section, and a second curved section. Similarly, the second amplifier member may extend from another end of the top side of the band to another end of the bottom side of the band and may be formed with a first curved section, a generally flat section, and a second curved section.

According to further implementations of a generally octagon-shaped propeller guard for use with a boat motor propeller, the propeller guard includes an inner circumferential component defining a single band sized and configured to surround the propeller and having eight sections being joined at eight joints, the band defining an inlet opening and an outlet opening and an outer fluid amplifier that includes a first amplifier member extending from the inner circumferential component and defining a first fluid channel extending along a first exterior side of the inner circumferential component and a second amplifier member extending from the inner circumferential component and defining a second fluid channel extending along a second exterior side of the inner circumferential component.

The band may include a plurality of ports formed therein and spaced there around, the plurality of ports allowing fluid flow between the exterior and interior surfaces of the band. The first amplifier member and the second amplifier member may each define an inner surface that is rotated relative to the exterior surface of the band such that the first fluid channel and the second fluid channel are wider proximate the inlet opening and narrower proximate the outlet opening, whereby movement of the propeller guard through a fluid such that fluid enters the first fluid channel and the second fluid channel proximate the inlet opening causes compression of the fluid in the first fluid channel and the second fluid channel, increasing flow of fluid through at least a portion of the plurality of ports having openings located in the first fluid channel or the second fluid channel. The first amplifier member and the second amplifier member may each comprise a shape generally conforming to an adjacent portion of the band of the inner circumferential component.

The above and other objects and advantages of the present invention are realized in illustrated embodiments thereof, shown and described by way of example and not by way of limitation, and the following detailed description of the invention and the drawings, in which similar structure is identified with similar numbers throughout

BRIEF DESCRIPTION OF THE SEVERAL VIEWS OF THE DRAWINGS

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE INVENTION

Figure 2:
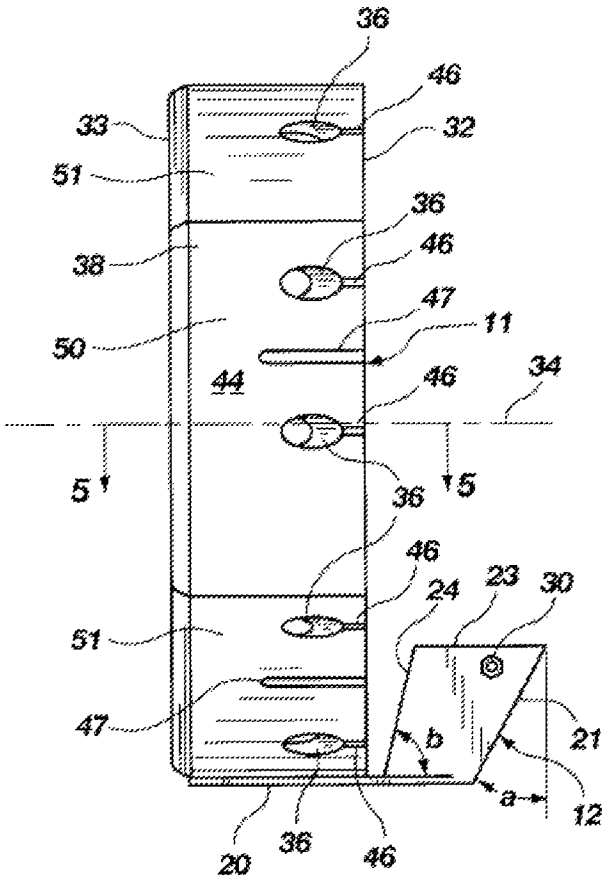
FIG. 2 is a side view of an inner circumferential component of the propeller guard formed in accordance with the principles of the present invention.

A description of embodiments of the present invention will now be given with reference to the Figures. It is expected that the present invention may take many other forms and shapes, hence the following disclosure is intended to be illustrative and not limiting, and the scope of the invention should be determined by reference to the appended claims.

Prop guards in accordance with embodiments of the present invention include an inner circumferential component 10 which is attachable to a motor of a motorboat as was described in the '062 patent to Taylor, Jr. In certain embodiments of the prop guard, the inner circumferential component 10 is largely similar to the prop guards disclosed in the '062 patent, and the inner circumferential component 10 provides significant functionality to the prop guards, which functionality is discussed herein. Accordingly, FIGS. 1-7 illustrate features of the inner circumferential component 10.

Prop guards including the inner circumferential component 10 of embodiments of the present invention are adapted for use on motorboats having either an outboard motor 13 (as shown in dashed lines in FIG. 1), or an inboard/outboard motor (not shown). The motor 13 includes a propeller 14 having blades 15 which are operatively connected inside motor 13 to a conventional-type drive. The inner circumferential component 10 of embodiments of the present invention is attached to the motor 13 at a position on the underside of a cavitation plate 16 of the motor 13 by an attachment plate 18, and to a lower fin 17 of the motor 13 by an attachment bracket 12, in a manner substantially similar to the prop guard described in the '321 patent to Taylor, Jr., which is incorporated herein by reference in its entirety as well as in the '062 patent to Taylor, Jr., which is also incorporated herein by reference in its entirety.

The inner circumferential component 10 of the prop guard of embodiments of the present invention is shown for purposes of illustration as being attached to a typical outboard motor 13. It is well within the scope of the present invention however to attach the inner circumferential component 10 to any size or type of outboard or inboard/outboard motor. Dimensions given herein below therefore are given for the purposes of describing the shown embodiment only, and are not given by way of limitation of the general invention. It should be understood that the particular dimensions identified are relative to one particular motor only and therefore would likely be modified should the inner circumferential component 10 be adapted for placement on other types or sizes of motors. Any such adaptions and modifications are specifically included within the scope of the present invention.

The inner circumferential component 10 is formed from a flat elongated rectangular band 11 of metal which has been formed into a multi-angled shape. It is understood that the inner circumferential component 10 need not be in a multi-angled shape, but could be in any known or novel configuration for a prop guard, including a substantially cylindrical shape. The metal may be aluminum, however, other metals such as stainless steel, or other materials such as composites, wood, or plastic may be used. In one embodiment of the inner circumferential component 10, the aluminum may have a length of approximately 4 feet, a width of approximately 4 inches and a thickness of approximately ¼ inch. When formed into the band 11, the nominal diameter of the band 11 so formed is approximately 1½ feet.

The attachment plate 18 may form part of the continuous circumference of the band 11 and may be of a length of approximately 7 inches, with a width of approximately 4 inches and a thickness of approximately ¼ inch. The attachment plate 18 may be bowed slightly (e.g., approximately ¼ inch inward) to conform to the curvature of the bottom of the cavitation plate 16 of the motor 13 to which it is to be attached. The attachment plate 18 may be drilled with holes 19, e.g., four, each approximately 5/16ths inches in diameter and each located at a corner of the attachment plate 18 approximately ¾ inch in from each side forming each corner. The band 11 may be manufactured by casting, or may be formed from one or more plates that are bent to the desired shape and then welded or otherwise joined to form the continuous band 11.

Figure 3:
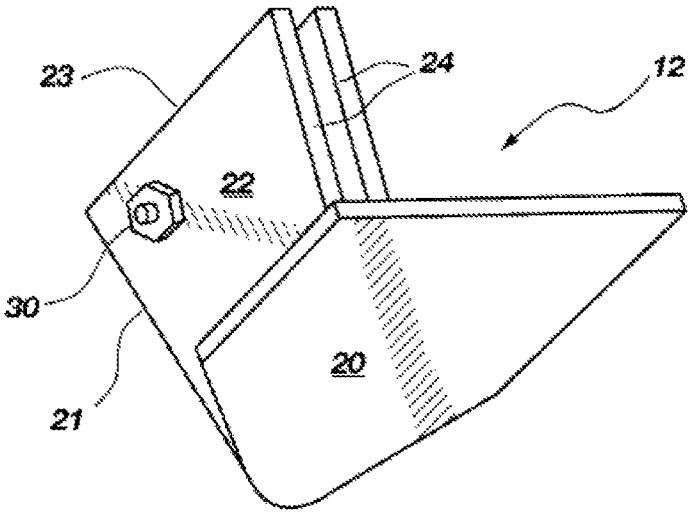
FIG. 3 is a side perspective view of an illustrative attachment bracket of a propeller guard.

As best shown in FIGS. 2 and 3, the attachment bracket 12 may be formed of stainless steel, and in one embodiment of the present invention, is formed of T304 stainless steel. The attachment bracket 12 includes a generally flat, rectangular metal plate 20 that may be approximately ¼ inch thick, which is attached to a pair of side plates 22. The side plates 22 are cut to form front edges 21 which are at an angle (a) of approximately 40° with the top edges 23 thereof. In one embodiment the angle (a) is approximately 38°. The rear edge 24 of side plates 22 may be cut to form an angle (b) of approximately 60° with the bottom edge thereof.

The metal plate 20 is attached to the band 11, such as by welding, at a position diametrically opposed to the center line 25 of the attachment plate 18. The side plates 22 may be attached to the lower fin 17 by means of a bolt 30 or bolts 30.

As best shown in FIG. 2, band 11 includes an inlet opening 32, an outlet opening 33 and a central longitudinal axis 34. From the center line 25 of attachment plate 18, proceeding in both directions around an interior surface 35 of the band 11, ports 36 are drilled or otherwise formed through the band 11 at 4-inch intervals around its entire circumference. The total number of ports 36 around the band 11 of the particular embodiment shown is 12. Each port 36 is centered approximately 1¼ inches rearward from the inlet opening 32 of the band 11. Each port 36 is drilled through the band 11 at an angle (c) (see FIG. 5) of less than 90° from the central axis 34 of the band 11. In the illustrated embodiment, the two ports 36 closest to attachment plate 18 are of a diameter of approximately 7/10 inch and formed at an angle (c) of approximately 35°, with the remaining ports 36 being of a diameter of approximately ½ inch and formed at an angle (c) of approximately 20°.

Figure 1:
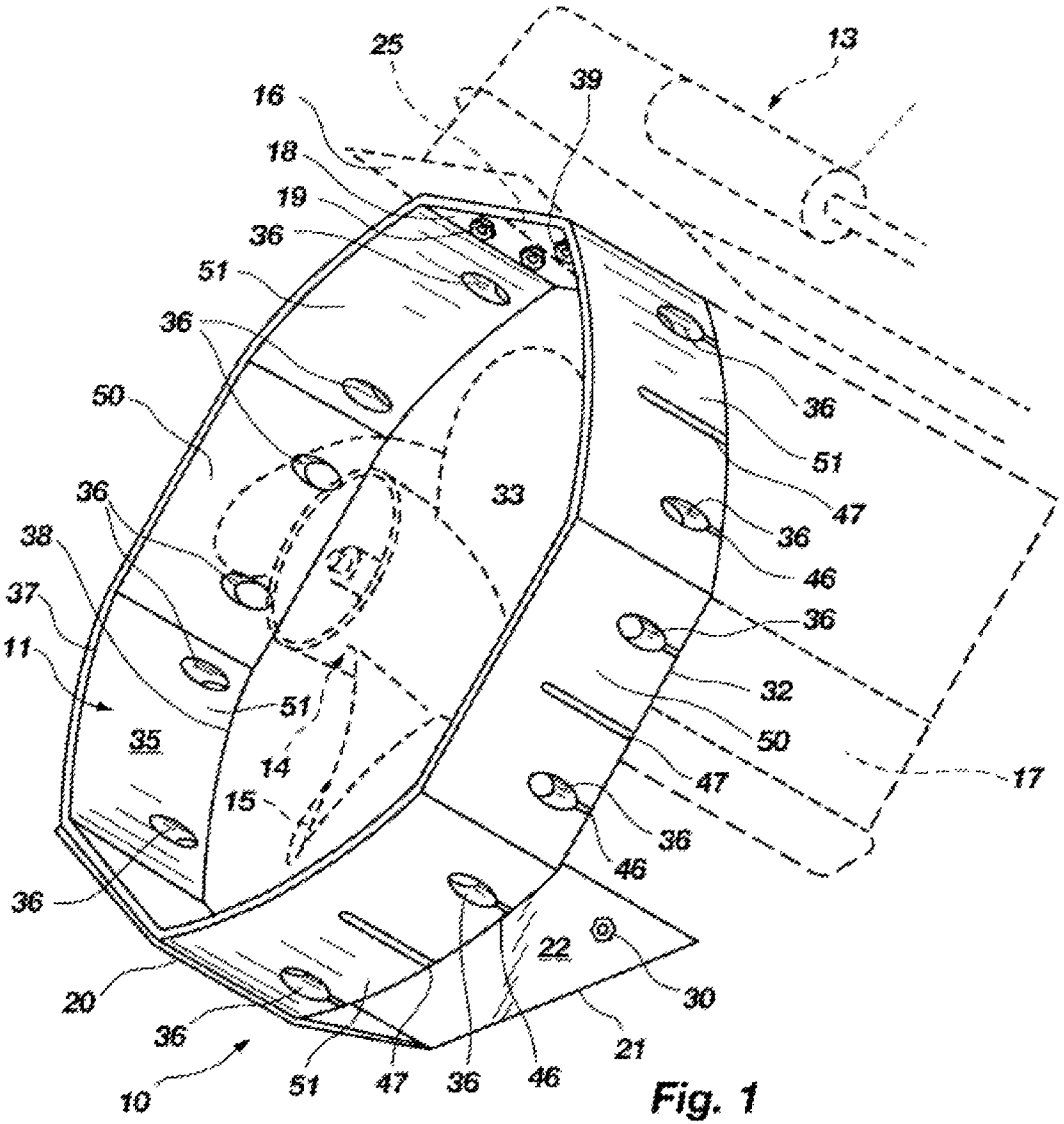
FIG. 1 is a perspective view of an inner circumferential component of a propeller guard formed in accordance with the principles of the present invention, showing the inner circumferential component attached to an outboard motor (drawn in dashed lines)
Figure 4:
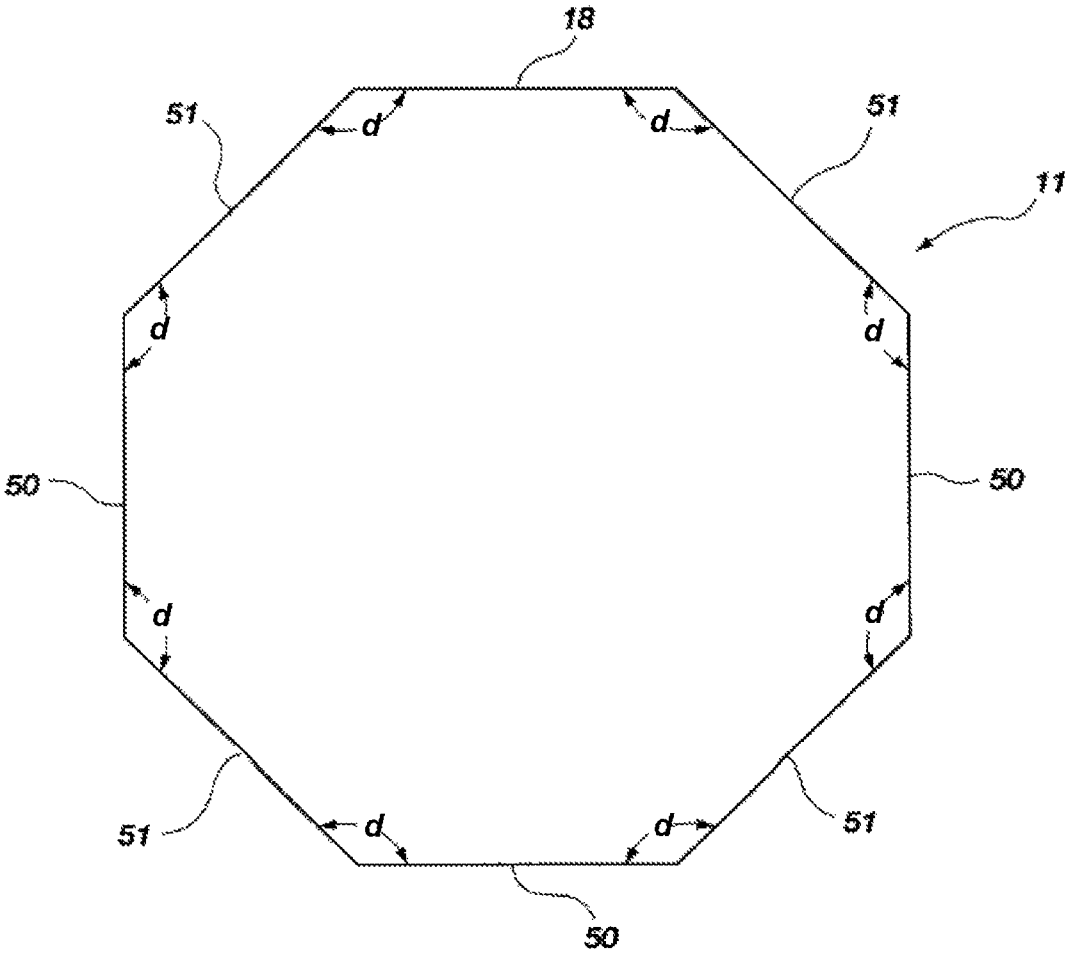
FIG. 4 is a front diagrammatical view of one embodiment of an inner circumferential component of a propeller guard formed in accordance with the principles of the present invention.

As shown in the diagrammatical view of FIG. 4, the band 11 is generally formed by a plurality of sections joined at each end to form a generally uniform, multi-angled shape. Each of the sections 50 and 51 of the band 11 in the embodiment shown in FIGS. 1-2 are formed to a predetermined radius, or are formed flat (defined as an "infinite radius"). It is not required for the embodiments of the invention as contemplated, for each section 51 to be identical in size and radius, or for each section 50 to be identical in size and radius, either to each other section 50 or to the sections 51. It also follows that no requirement for symmetry therefore exists. However, the illustrated embodiment of FIGS. 1-2 includes sections 50 and 51 being generally symmetrical with their respective counterpart sections 50 and 51 about a plane passing through the center of attachment plate 18 and attachment bracket 12. The effect of the angles (d) joining sections 50 and 51 is to cause portions of the band 11 (e.g., central portions of each section 50 and 51) to be positioned closer to the prop blades 15 than other portions (e.g., corner portions where sections 50 join sections 51), as is readily apparent. During operation, rotation of blades 15 consecutively past each section 50 and 51 causes the water pressure at the blades 15 to fluctuate. This pressure fluctuation effectively allows the water to be "flushed" through the inner circumferential component 10 in a more rapid manner than prior-art cylindrical prop guards. This water-pressure-fluctuation effect is generated by the shape of the band 11, and is independent of whether or not the ports 36 are present. In this respect therefore, ports 36 are only an optional part of certain embodiments of the present invention and constitute only one possible embodiment thereof.

Figure 5:
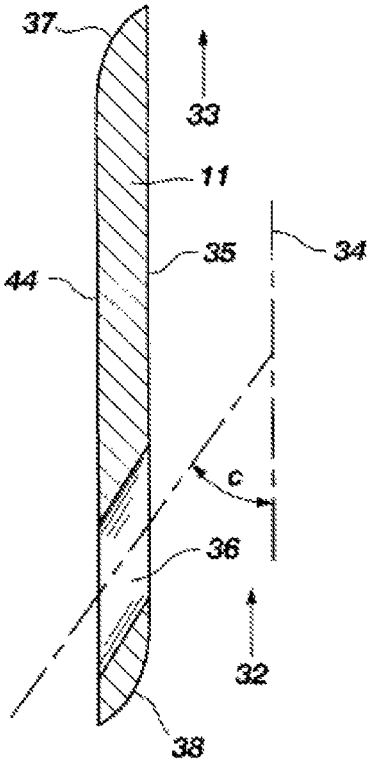
FIG. 5 is a cross-sectional view through one side of an embodiment of the inner circumferential component taken along line 5-5 of FIG. 2.

As shown in FIGS. 2 and 5, an exterior surface 44 of the band 11 at the outlet opening 33 thereof may be shaped with a somewhat convex tapered rear end surface 37. Similarly, as illustrated in FIG. 5, the interior surface 35 of the band 11, at the inlet opening 32 thereof may be formed with a somewhat convex tapered front end surface 38.

The inner circumferential component 10 is attached to the motor 13 by locating attachment plate 18 against the bottom surface of cavitation plate 16 and bolting the attachment plate 18 thereto by bolts 39 passing through openings 19. The side plates 22 are then bolted by one or more bolts 30 to the lower fin 17 of the motor 13. The preferred mounted position of the inner circumferential component 10 locates the plane of the rear end surface 37 of the outlet opening 33 approximately ¾ to 1½ inches beyond (rearward of) the propeller 14.

Figure 6:
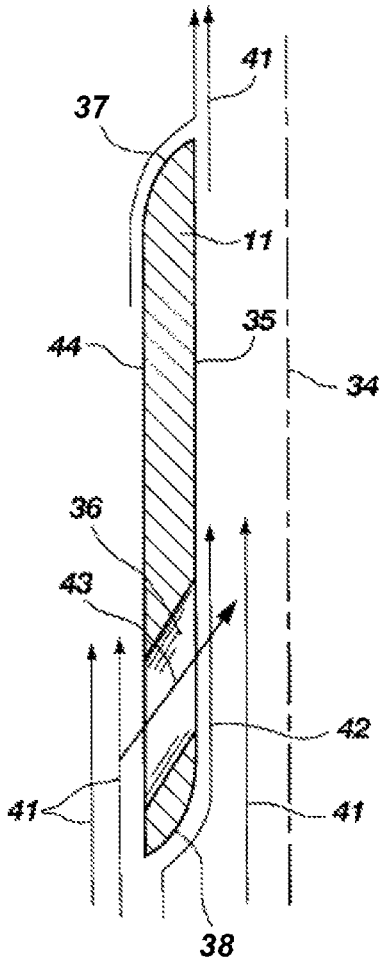
FIG. 6 is a first cross-sectional view similar to that of FIG. 5 with arrows showing water flow direction.

As best shown in FIG. 6, the inner circumferential component 10 when in operation, is generally oriented to allow water to pass along the longitudinal axis 34 thereof (as shown by lines 41). The front end surface 38 of band 11 is shaped so as to cause water flowing there against, such as represented by line 42, to be diverted to flow along interior surface 35. Because line 42 has been diverted, as is well known in fluid dynamics, the diversion of water flow as represented by line 42 causes the speed of fluid represented by line 42 to be increased. This in turn causes a vacuum effect through ports 36 (if present). The vacuum effect generated in ports 36 causes water to be drawn from the exterior surface 44 of band 11, through ports 36 and into the interior thereof (as shown by flow line 43).

The net effect of the front end surface 38 and ports 36 on the water flowing there past is to draw a portion of the water from the exterior 44 of the band 11 into the interior area of the band 11 where it can impinge upon the propeller 14, thus increasing the thrust capability of the motor 13.

Figure 7:
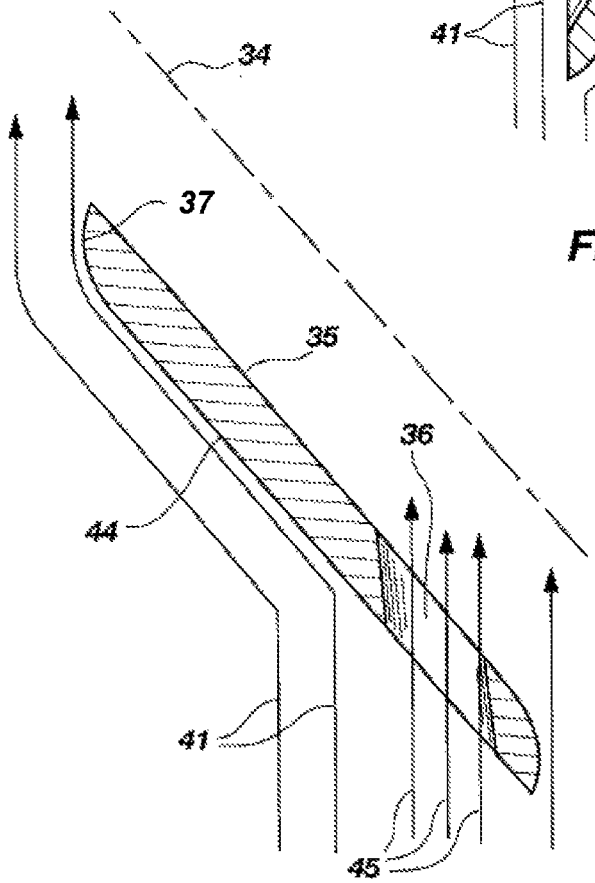
FIG. 7 is a second cross-sectional view similar to that of FIG. 5 with arrows showing water flow direction.

As shown in FIG. 7, when the motor 13 is moving at a velocity through the water, and the propeller is rotated relative to the flow of water in order to effect a turn, it can be seen that water flow lines 41 will impinge upon exterior surface 44 of the band 11, and be diverted over the convex taper of the rear end surface 37 at the outlet opening 33. In prior-art prop guards, when the propeller is rotated to effect such a turn, water is blocked from the propeller by the exterior surface of the guard. However, in embodiments of the prop guard, rotation of the propeller 14 to effect a turn causes band 11 to orient a plurality of the ports 36 (those ports 36 lying directly in line with the water flow lines 45) to be oriented such that water can flow directly through ports 36 and into the blades 16 of the propeller 14, without interference from the band 11.

Prior-art prop guards completely inhibit flow of water directly into the propeller during a turn such as shown by FIG. 7, and therefore cause cavitation in the area of the propeller. The cavitation causes a loss of thrust of the motor which in turn causes a loss of steering control. The design of the inner circumferential component 10, when also including the ports 36, ensures that a flow of water is always directed into the propeller 14, even while effecting sharp turns at high speeds.

Figure 11:
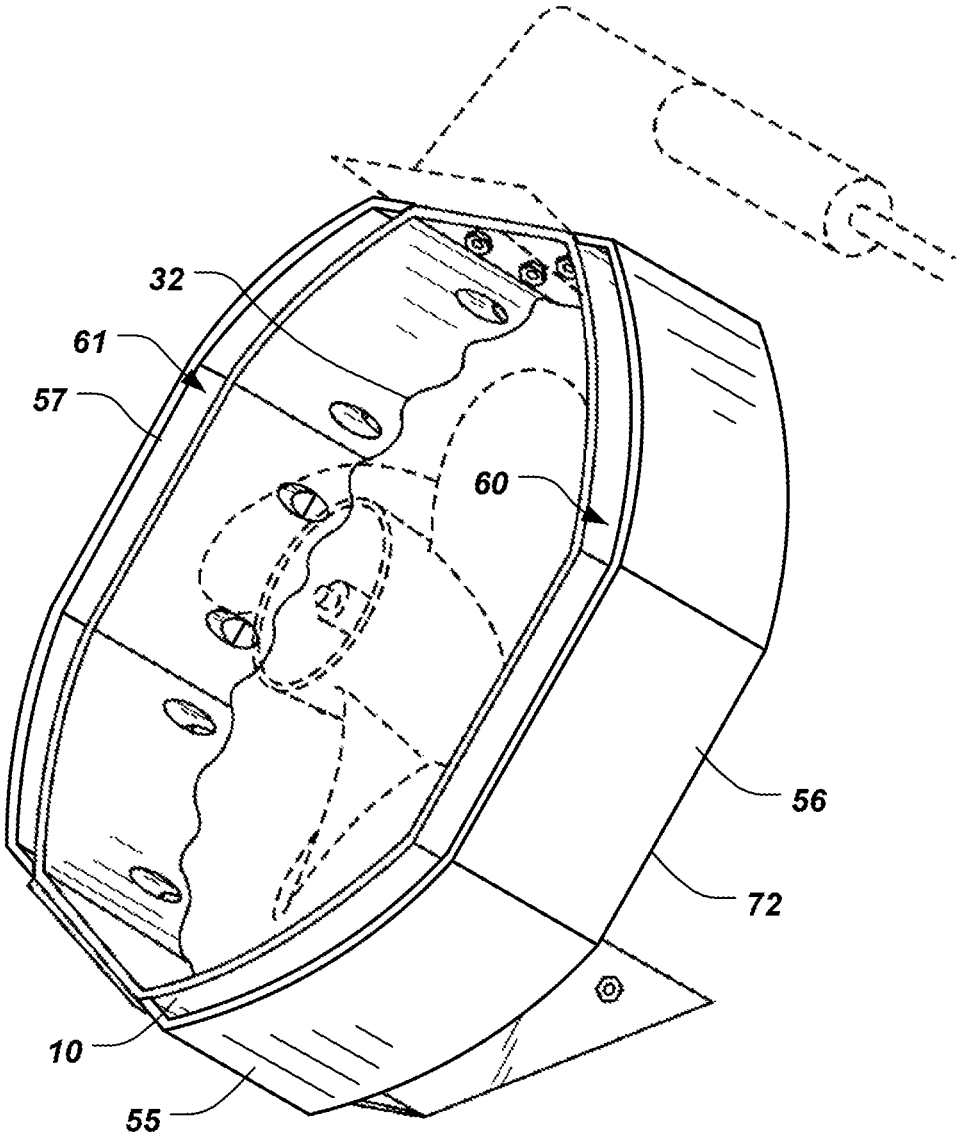
FIG. 11 is a perspective view of an alternative embodiment of a propeller guard having an inner circumferential component, with the inlet opening thereof formed in a sinusoidal configuration, and an outer fluid amplifier.

In some embodiments, as shown in FIG. 11, the inlet opening 32 of the inner circumferential component 10 of the present invention may alternatively be designed to form a sinusoidal surface around the band 11. The sinusoidal shape of the inlet opening 32, as opposed to the generally circular shape of the band 11 of the inner circumferential component 10 as shown in the embodiments of FIGS. 1-2, is additionally intended to assist in lowering the coefficient of drag against the inner circumferential component 10 as it passes through the water during use.

As shown in FIGS. 1-2, if desired, the band 11 may also include a series of grooves 46 located on the exterior surface 44 of the band 11 to extend from the inlet opening 32 into each of the ports 36, such that each groove 46 is oriented parallel to the central longitudinal axis 34. Similar grooves 47 may be located parallel to grooves 46 and spaced between each port 36 to extend either partially or entirely along the exterior surface 44 of the band 11. These grooves 46 and 47 aid in increasing the stability of the guard 10 as it moves through the water, and also, in the case of grooves 46, which water can be drawn in through ports 36. Though not specifically numbered in the embodiment of FIG. 11, similar grooves 46 and grooves 47 may be present in alternate embodiments including the sinusoidal shaped inlet opening 32.

A prop guard formed solely of the inner circumferential component 10 has been tested to verify the performance characteristics thereof during actual use. In a first test, a 115 hp outboard engine was fitted with a 19 pitch stainless steel propeller. The motor was attached to a boat and run at top speed (with throttle wide open) and reached a speed of 37 mph at 5500 rpm. The prop guard formed solely of the inner circumferential component 10 was then attached to the motor and the motor was again run to top speed. The top speed of the motor including the prop guard attached thereto was 36 mph at 5250 rpm. The prop guard formed solely of the inner circumferential component 10 was then removed and replaced with a prior-art prop guard. Top speed of the motor with the prior-art prop guard attached thereto was 30 mph at 4800 rpm.

A second series of tests were performed using the prop guard formed solely of the inner circumferential component 10. In this test, a 115 hp outboard motor with a 15 pitch aluminum propeller was fitted with a ring similar to band 11 of the inner circumferential component, however in this embodiment without any ports 36 extending therethrough and without any tapering of the rear end surface 37 or of the front end surface 38 thereof. The motor was run at full throttle and reached 29 mph at 5000 rpm.

Next, the band 11 was tapered at the rear end surface 37 thereof, in the manner as described in the disclosure, and the motor was again run at full throttle. The motor reached 30 mph at 5300 rpm.

Next, the band 11 was tapered at the front end 37 thereof, and the motor was run at full throttle. The motor reached 32 mph at 5000 rpm.

Next, the ports 36 were drilled in the band 11 at the angle as described above in the disclosure, and the motor was again run at full throttle. The motor reached 34 mph at 5750 rpm. The prop guard formed solely of the inner circumferential component 10 was then completely removed from the motor and the motor was run at full throttle and reached a speed of 35 mph at 5750 rpm.

A third test was conducted to determine the period of time necessary to cause the boat to come to a level position from a starting position dead in the water, to an ending point at top speed. Using a 19 pitch stainless prop with a 115 hp outboard motor, and a prop guard formed of the inner circumferential component 10 alone, the average time to level the boat was 15 seconds. Without the inner circumferential component 10, the average time to level the boat was 17.6 seconds. The test therefore showed that a prop guard formed solely of the inner circumferential component 10 of embodiments of the present invention helped the boat come to a level position more quickly than without its use. This is important because the boat operators' visibility is impaired until the boat reaches a level position. Further, a quicker leveling of the boat allows the boat to be used to pull water skiers with greater ease.

As has also been shown by the aforementioned tests, there is very little power loss with use of prop guards formed solely of the inner circumferential component 10 attached to the motor 13. Further, the control and handling of the boat with the inner circumferential component 10 of embodiments of the present invention is easier since cavitation is greatly reduced or eliminated, especially during hard turns.

In actual use, there have been other noted advantages of embodiments of the prop guard formed solely of the inner circumferential component 10. For example, in very choppy water, the inner circumferential component 10 eliminates keel waking, thereby aiding in keeping the boat under control. Also, as shown by the tests above, with the use of the prop guard formed solely of the inner circumferential component 10, it is possible to achieve similar top speeds from either a 15-pitch propeller or a 19-pitch propeller. This allows the use of a lower-pitch propeller (which has the advantages of higher power when accelerating from a dead stop) yet allows the propeller nevertheless to retain a good top-end speed (such as is generally the purpose of a higher-pitched prop). In other words, use of the prop guard formed solely of the inner circumferential component 10 allows a lower-pitched propeller to take on the characteristic of a more elaborate (and expensive) two-speed propeller.

While use of prop guards formed solely of the inner circumferential component 10 provide propeller protection as well as additional advantages as noted above, further developments have been made to further improve prop guards by the provision of an outer fluid amplifier 55 used in conjunction with the inner circular component 10 as illustrated in FIGS. 8-15. In the embodiments of the prop guard discussed with respect to FIGS. 8-15, the features of the inner circumferential component 10, of the attachment bracket 12, and of the attachment plate 18 may be largely similar to the features discussed above with respect to the prop guard embodiments formed solely of the inner circumferential component 10 as discussed and illustrated with respect to FIGS. 1-7. Accordingly, such similar features are largely not illustrated or referenced in FIGS. 8-15, except where specific reference to similar components aids in discussing the features of prop guards incorporating the outer fluid amplifier 55.

As illustrated in FIGS. 8-15, the outer fluid amplifier 55 may be attached to or formed with the inner circumferential component 10, such as proximate the attachment bracket 12 and the attachment plate 18. In embodiments where the outer fluid amplifier 55 is attached to the inner circumferential component 10, it may be attached using any appropriate attachment mechanism or methodology, such as bolts, screws, welding (e.g., friction stir welding or any other form of welding appropriate for the material of which the inner circumferential component 10 and/or the outer fluid amplifier 55 is formed), or other forms of attachment. In embodiments where the outer fluid amplifier 55 is formed with the inner circumferential component 10, the outer fluid amplifier 55 may be simultaneously formed with the inner circumferential component, such as by casting. Those of ordinary skill in the metallurgical arts will recognize appropriate methods for attaching the outer fluid amplifier 55 to the inner circumferential component 10 or for forming the outer fluid amplifier 55 with the inner circumferential component 10.

In some embodiments, the outer fluid amplifier 55 is essentially permanently attached to or formed with the inner circumferential component 10. In such embodiments, the prop guard always includes the inner circumferential component 10 and the outer fluid amplifier 55. In other embodiments, the outer fluid amplifier 55 is reversibly affixed to the inner circumferential component 10. In such embodiments, the prop guard may be used with the inner circumferential component 10 alone, or with the outer fluid amplifier 55 attached thereto.

The outer fluid amplifier 55 may be formed of a material similar to or identical to the material used for the inner circumferential component 10. By way of example only, the outer fluid amplifier 55 and the inner circumferential component 10 may be formed of aluminum or aluminum alloys. Alternatively, the outer fluid amplifier 55 and the inner circumferential component 10 may be formed of stainless steel or other metals or metal alloys. In some embodiments, the outer fluid amplifier 55 and the inner circumferential component 10 may be formed of various composites, woods or plastic materials. In some embodiments, the outer fluid amplifier 55 and the inner circumferential component 10 may be formed of or include carbon fiber materials. In some embodiments, the outer fluid amplifier 55 and the inner circumferential component 10 may be formed of various composite materials and combinations of materials. For example, the outer fluid amplifier 55 and the inner circumferential component 10 may be formed of various layers of similar or different materials.

Figure 8:
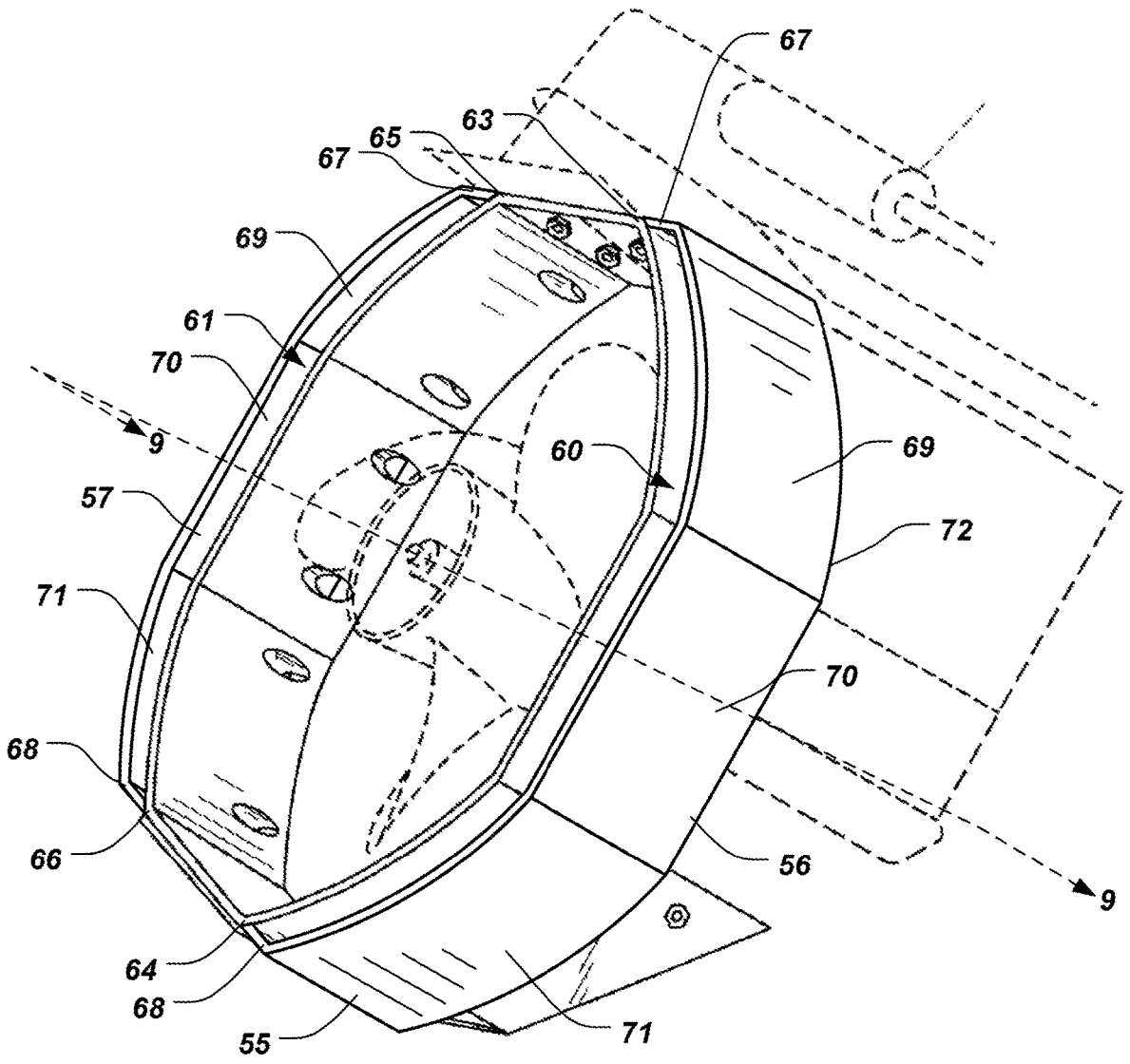
FIG. 8 is a perspective view of one embodiment of a propeller guard having an inner circumferential component and an outer fluid amplifier.
Figure 9:
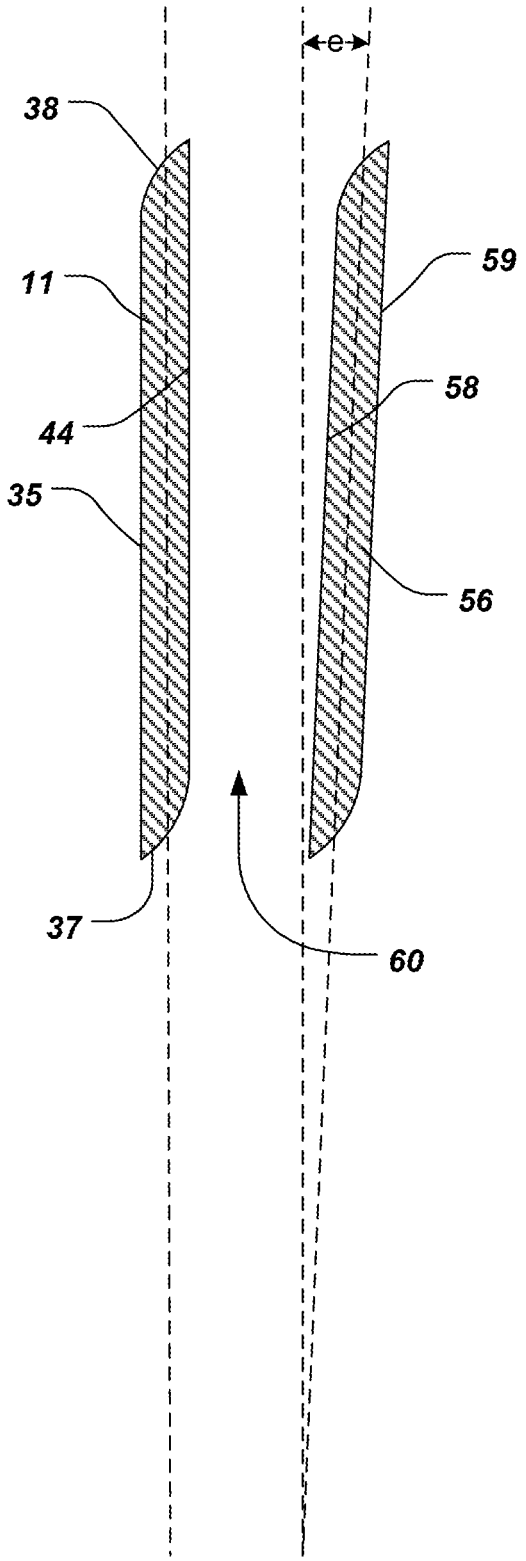
FIG. 9 is a cross-sectional view through one side of an embodiment of a propeller guard taken along line 9-9 of FIG. 8.
Figure 10:
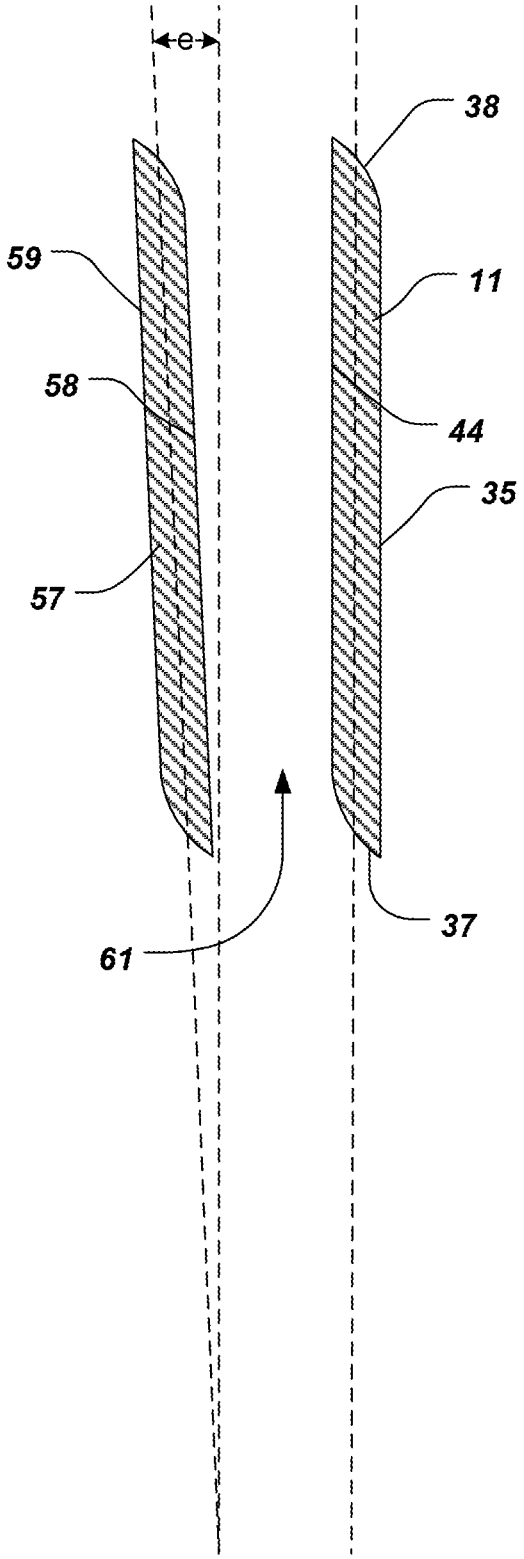
FIG. 10 is a cross-sectional view through the other side of an embodiment of a propeller guard taken along line 9-9 of FIG. 8.

The outer fluid amplifier 55 of FIG. 8 includes a right amplifier member 56 and a left amplifier member 57. Each of the right amplifier member 56 and the left amplifier member 57 has an inner surface 58 and an outer surface 59, as best illustrated in the cross-sectional views of FIGS. 9 and 10. The inner surface 58 of the right amplifier member 56 and the left amplifier member 57 is located opposite the exterior surface 44 of the band 11, thereby forming a first fluid channel 60 between the band 11 and the right amplifier member 56 (FIG. 9) and a second fluid channel 61 between the band 11 and the left amplifier member 57 (FIG. 10). Each of the first fluid channel 60 and the second fluid channel 61 generally extends along a side of the inner circumferential component 10. The right amplifier member 56 generally extends from an upper right portion 63 of the inner circumferential component 10 to a lower right portion 64 of the inner circumferential component 10 along a right side of the inner circumferential component 10. Similarly, the left amplifier member 57 generally extends from an upper left portion 65 of the inner circumferential component 10 to a lower left portion 66 of the inner circumferential component 10.

In the embodiment of FIG. 8, the right amplifier member 56 and the left amplifier member 57 initially extend from the inner circumferential component 10 in a direction generally parallel to the attachment plate 18 and the lower section 50 and the metal plate 20. Accordingly, an upper portion 67 of each of the right amplifier member 56 and the left amplifier member 57 is generally parallel to a lower portion 68 of each of the right amplifier member 56 and the left amplifier member 57, respectively, in this embodiment. Each of the right amplifier member 56 and the left amplifier member 57 includes three sections sequentially extending between the respective upper portion 67 and the respective lower portion 68. Section 69 is joined to the upper portion 67 and extends therefrom. Section 70 is joined to and extends from section 69. Section 71 is joined to section 70 and extends therefrom to the lower portion 68.

As may be seen in FIG. 8, the sections 69 and the section 71 may be radiused similar to the sections 51 of the inner circumferential component. The sections 69 and 71 have similar radii to each other as may be seen in FIG. 8. In other embodiments, however, the sections 69 and 71 may have differing radii. The sections 70 may be flat (infinitely radiused) similar to the side sections 50 of the inner circumferential component 10. Alternatively, in other embodiments, the sections 70 may have a radius other than an infinite radius. The radii of the sections 69, the sections 70, and the sections 71 may be similar to the radii of their immediately adjacent sections 51 or sections 50 of the inner circumferential component 10. In other embodiments, the radii of the sections 69, the sections 70, and the sections 71 may differ from the radii of the immediately adjacent sections 51 or sections 50.

The right amplifier member 56 and the left amplifier member 57 generally define internal surfaces that are adjacent to the exterior surface 44 of the inner circumferential component 10. Accordingly, the outer fluid amplifier 55 and the inner circumferential component 10 define a pair of flow paths for water flow between the inner circumferential component 10 and the outer fluid amplifier 55. The internal surface of the right amplifier member 56 and the left amplifier member 57 may be rotated relative to the exterior surface 44 of the inner circumferential component, such that the flow paths are slightly wider proximate the inlet opening 32 and narrower proximate the outlet opening 33. In some embodiments, the inner surfaces 58 of the outer fluid amplifier 55 (e.g., of the right amplifier member 56 and of the left amplifier member 57) are rotated an angle (e) approximately 2° to approximately 3° from parallel to the exterior surface 44 of the inner circumferential component, as illustrated in FIGS. 9 and 10.

Because the flow paths narrow over their length, the pressure of the fluid passing between the inner circumferential component 10 and the outer fluid amplifier 55 is increased between the inner band 11 and the outer partial band of the outer fluid amplifier 55. The increased pressure forces additional water to flow through the ports 36 of the inner circumferential component. This excess blow-by is then directed out the back by action of movement of the prop guard through the water and by action of the propeller, aiding in steering and handling of the boat.

In some embodiments, the right amplifier member 56 and the left amplifier member 57 may be formed with convex tapered ends similar to the convex tapered ends of the inner circumferential component 10 as discussed with respect to FIGS. 2 and 5. Accordingly, an exterior surface of the right amplifier member 56 and an exterior surface of the left amplifier member 57 proximate to the outlet opening 33 may be shaped with a somewhat convex tapered rear end surface. Similarly, an interior surface of the right amplifier member 56 and an interior surface of the left amplifier member 57 proximate to inlet opening 32 may be formed with a somewhat convex tapered front end surface.

The right amplifier member 56 and the left amplifier member 57 of the outer fluid amplifier 55 may have a leading edge 72 that is formed having a contour that is similar to or different from the contour of the inlet opening 32 of the inner circumferential component 10. For example, in the embodiment of FIG. 8, the inlet opening 32 of the inner circumferential component 10 is substantially flat or substantially on a single plane. In this embodiment, a leading edge 72 of the right amplifier member 56 and of the left amplifier member 57 of the outer fluid amplifier 55 may also be generally flat. The plane of the leading edge 72 of the outer fluid amplifier 55 may generally coincide with the plane of the inlet opening 32 of the inner circumferential component 10. Alternately, the plane of the leading edge 72 of the outer fluid amplifier 55 may slightly lead or trail the plane of the inlet opening 32 of the inner circumferential component 10.

In some embodiments, the leading edge 72 of the right amplifier member 56 and the left amplifier member 57 of the outer fluid amplifier 55 may not fall all on a single plane, but the leading edge 72 of the right amplifier member 56 and the left amplifier member 57 of the outer fluid amplifier 55 may be swept back or forward to some extent. In such embodiments, the shape of the inlet opening 32 of the inner circumferential member may be flat or may be similarly swept, as desired.

In some embodiments, the leading edge 72 of the right amplifier member 56 and the left amplifier member 57 of the outer fluid amplifier 55 may differ from the shape of the inlet opening 32 of the inner circumferential member 10, as illustrated in FIG. 11. In this embodiment, the inner circumferential component 10 has a sinusoidal surface at the inlet opening 32 extending around the band. As discussed above, the sinusoidal shape of the inlet opening 32 may assist in lowering the coefficient of drag against the inner circumferential component 10 as it passes through the water during use. As may be seen in FIG. 11, however, the outer fluid amplifier 55 maintains a leading edge 72 that is generally all in a single plane. Accordingly, the leading edge 72 of the outer fluid amplifier differs in shape from the front surface at the inlet opening 32 of the inner circumferential component 10. While this is a single example of the inner circumferential component 10 and the outer fluid amplifier 55 having differing shapes, other examples are embraced as further embodiments of the invention.

Figure 12:
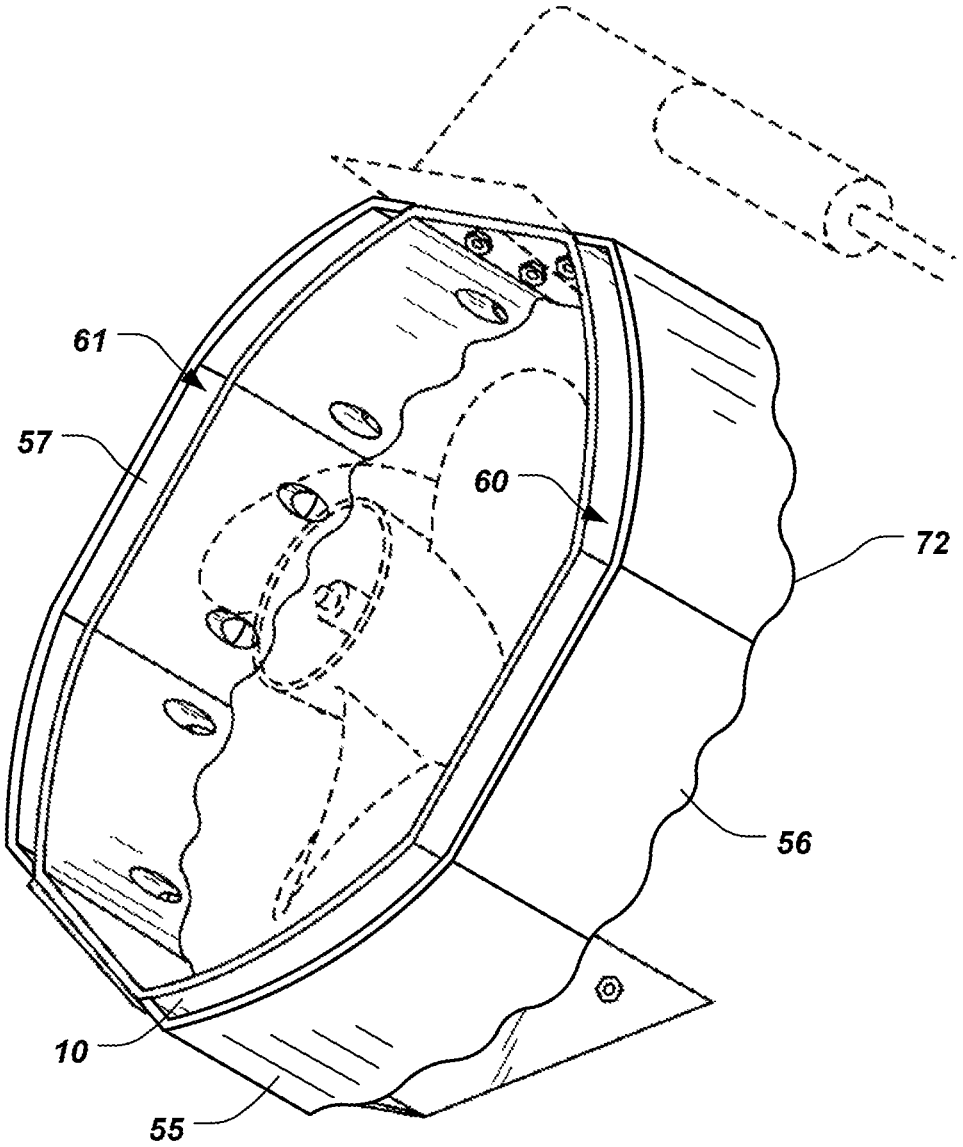
FIG. 12 is a perspective view of an alternative embodiment of a propeller guard having an inner circumferential component and an outer fluid amplifier, both having a leading edge formed in a sinusoidal configuration.

FIG. 12 shows another embodiment of a prop guard, this embodiment being one in which the leading edge 72 of the outer fluid amplifier 55 has a shape that is similar to the shape of the inlet opening 10 while differing from a generally planar shape. In this exemplary embodiment, the leading edge 72 of the outer fluid amplifier 55 forms a sinusoidal surface while the inlet opening 32 of the inner circumferential component 10 also forms a similar sinusoidal surface.

Figure 13:
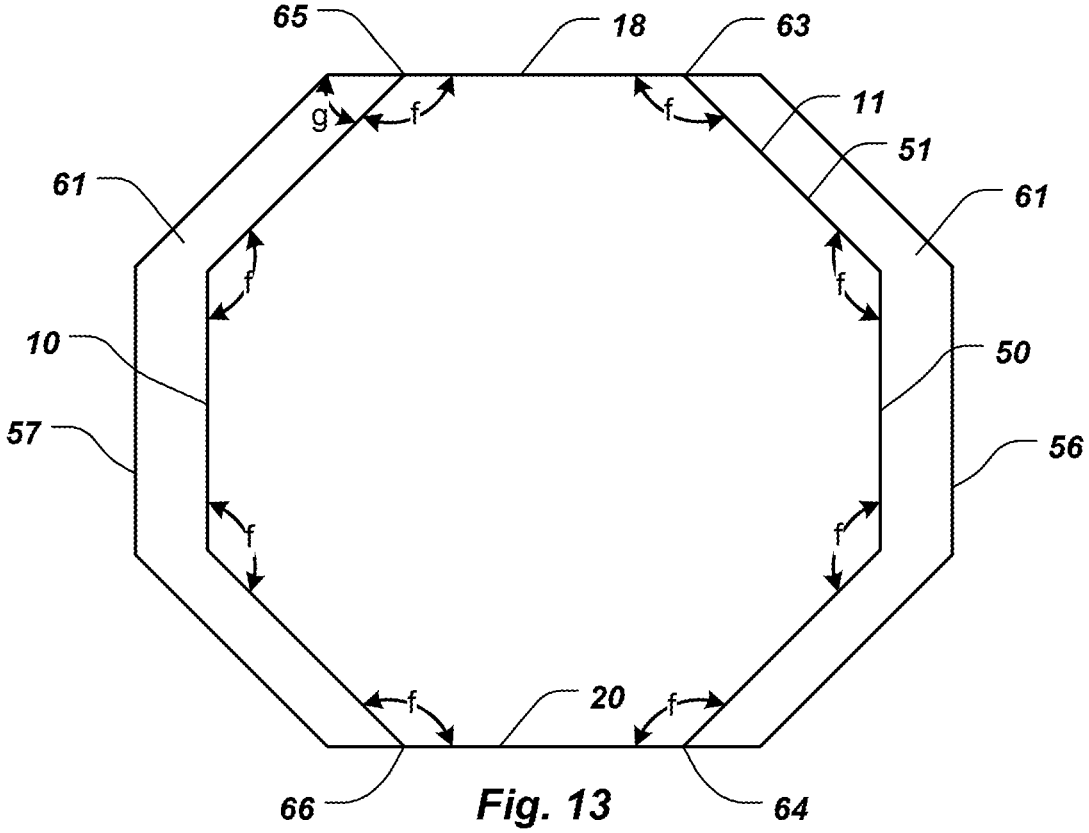
FIG. 13 is a rear diagrammatical view of one embodiment of a propeller guard formed of an inner circumferential component and an outer fluid amplifier.

FIGS. 13-16 provide rear diagrammatical views of embodiments of prop guards illustrating variations of the prop guards and the relationships between the inner circumferential component 10 and the outer fluid amplifier 55. The views of FIGS. 13-16 are similar to the view of FIG. 4 (in which the outer fluid amplifier 55 is not depicted). In the embodiments of FIG. 13, the inner circumferential component 10 has sections 50 and sections 51 joined to form the band 11 as has been previously discussed. These sections 50 and sections 51 are joined at angles (f) to have the effect of making portions of the band 11 lie closer to the propeller 14, which causes variations in the pressure of the propeller as it spins as discussed previously.

Figure 14:
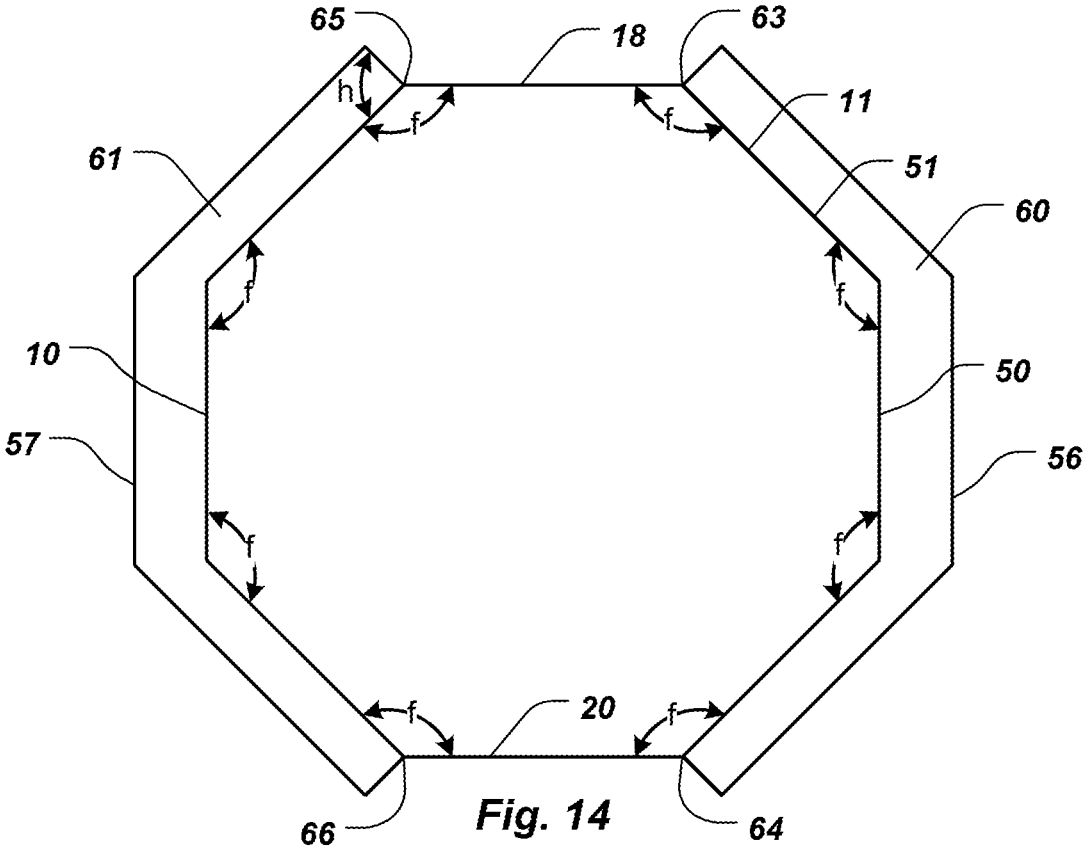
FIG. 14 is a rear diagrammatical view of another embodiment of a propeller guard formed of an inner circumferential component and an outer fluid amplifier.

The embodiment of FIG. 13 differs from the embodiment of FIG. 14 in the angle at which the outer fluid amplifier 55 (e.g., the right amplifier member 56 and the left amplifier member 57) joins the inner circumferential component 10. In the embodiment of FIG. 13, the right amplifier member 56 and the left amplifier member 57 join the inner circumferential component 10 at an angle (g) by which the upper right portion 63, the lower right portion 64, the upper left portion 65 and the lower left portion 66 are all substantially parallel to the attachment plate 18 and the metal plate 20. In contrast, in the embodiment of FIG. 14, the right amplifier member 56 and the left amplifier member 57 join the inner circumferential component 10 at a greater angle (h) by which the upper right portion 63, the lower right portion 64, the upper left portion 65 and the lower left portion 66 extend away from the inner circumferential component 10 at an angle that is more radially oriented.

In the embodiments illustrated in FIGS. 13 and 14, the sections 51 of the inner circumferential component 10 (see FIG. 4) have an infinite radius (are flat). In contrast, in the embodiments illustrated in FIGS. 15 and 16, the sections 51 of the inner circumferential component 10 are radiused so that they have a pronounced curve. The differences between these embodiments illustrate that the curvature of each of the sections 50 and sections 51 may be varied from the specific curvature shown in the Figures. As a result of the increased curvature of the sections 51 of the embodiments of FIGS. 15 and 16, the sections 50 are joined to the sections 51 at an angle (j) that is greater than the angle (f) shown in FIGS. 13 and 14.

Figure 15:
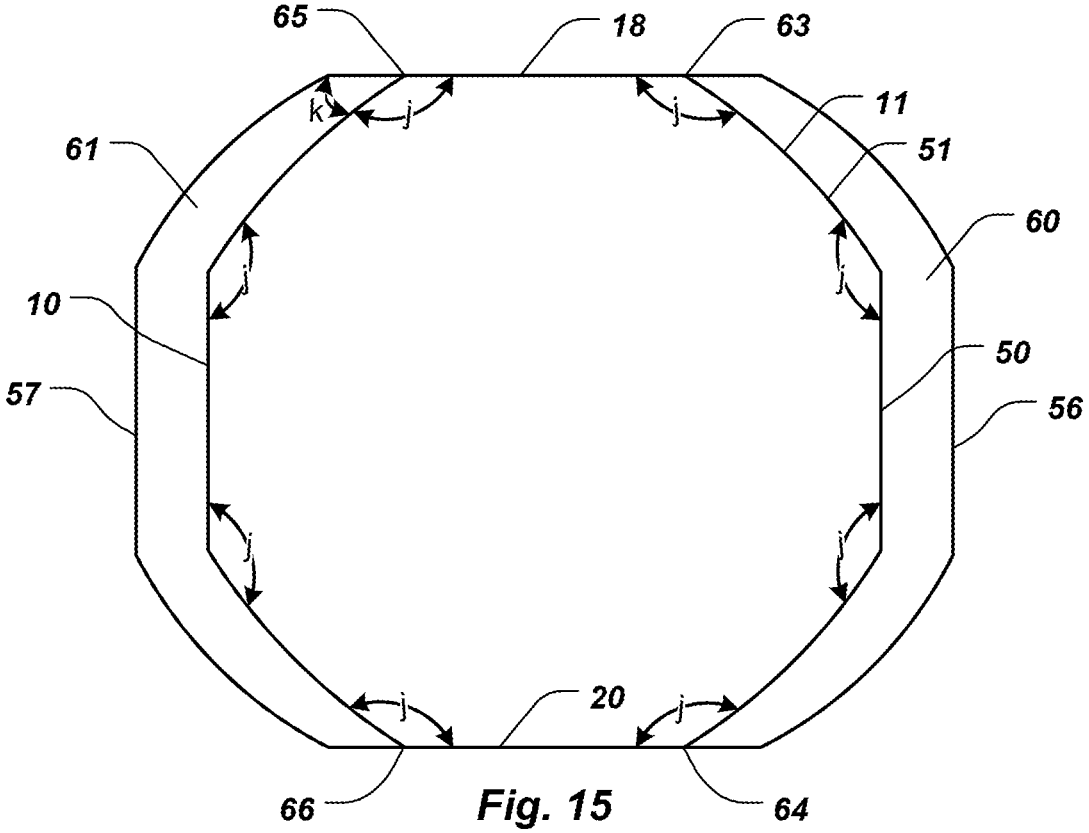
FIG. 15 is a rear diagrammatical view of another embodiment of a propeller guard formed of an inner circumferential component and an outer fluid amplifier.
Figure 16:
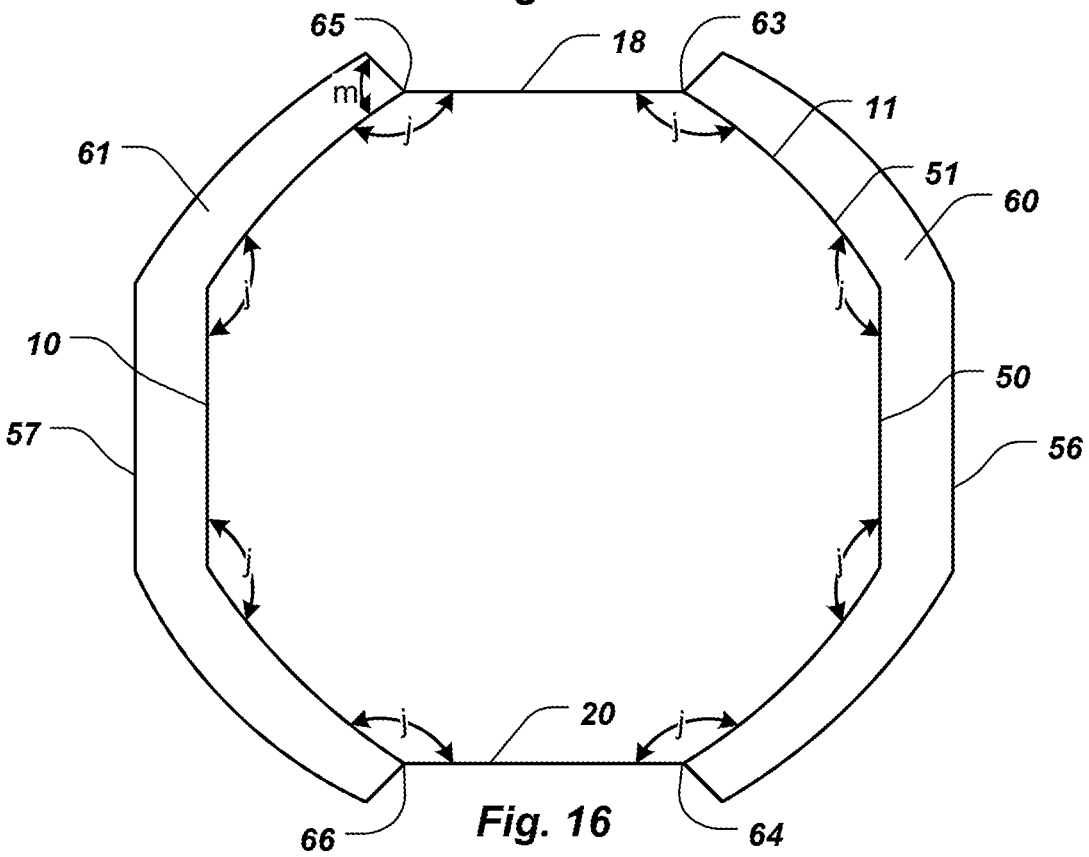
FIG. 16 is a rear diagrammatical view of another embodiment of a propeller guard formed of an inner circumferential component and an outer fluid amplifier.

The embodiment of FIG. 15 is otherwise similar to the embodiment of FIG. 13 in several regards. Specifically, the angle (k) at which the right amplifier member 56 and at which the left amplifier member 56 join the inner circumferential component 10 is chosen such that the upper right portion 63, the lower right portion 64, the upper left portion 65 and the lower left portion 66 are all substantially parallel to the attachment plate 18 and the metal plate 20. In contrast, in the embodiment of FIG. 16, as with the embodiment of FIG. 14, the right amplifier member 56 and the left amplifier member 57 join the inner circumferential component 10 at a greater angle (m) by which the upper right portion 63, the lower right portion 64, the upper left portion 65 and the lower left portion 66 extend away from the inner circumferential component 10 at an angle that is more radially oriented.

In FIGS. 8-16, the outer fluid amplifier 55, and particularly the right amplifier member 56 and the left amplifier member 57 have been illustrated as being spaced apart from the inner circumferential component 10 by a certain amount. The amount of space between the right amplifier member 56 and the inner circumferential component 10 and between the left amplifier member 57 and the inner circumferential component (e.g., between section 70 and its immediately adjacent section 50) may be varied by experimentation to achieve desired performance characteristics for the prop guard. As may be appreciated, this spacing may be scaled up and down with the prop guard to provide embodiments adapted for use with different-size propellers and/or motors.

In general, however, the amount of spacing between the outer fluid amplifier 55 and the inner circumferential component 10 may be related to width of the band forming the inner circumferential component 10. For example, wider bands forming the inner circumferential component 10 and the outer fluid amplifier 55 will be spaced further apart than narrower bands forming the inner circumferential component 10 and the outer fluid amplifier 55. In relation to the inner circumferential component 10, the outer fluid amplifier 55 may be spaced from approximately 20% to about 35% of the width of the inner circumferential component 10. In a non-limiting example, the band forming the inner circumferential component 10 has a width of about 4 inches, and the spacing or separation distance of the inner circumferential component 10 and the outer fluid amplifier 55 ranges from about 0.75 inch to about 1.5 inch.

Testing of embodiments of the prop guard having the outer fluid amplifier have shown distinct benefits over embodiments of the prop guard formed solely of the inner circumferential component 10 (e.g., without an outer fluid amplifier—references herein to a prop guard formed solely of the inner circumferential component 10 mean not having the outer fluid amplifier 55, they still have means to attach the prop guard to the motor). For example, a prop guard having an outer fluid amplifier 55 was used on a boat and compared to the same boat and motor using a prop guard having only the inner circumferential component 10 without the outer fluid amplifier 55.

In tests of the two versions of the prop guard, the boat took an average of 6.491 seconds to plane using the prop guard without the outer fluid amplifier 55. In contrast, the same boat/motor took only 6.155 seconds to plane using the prop guard with the outer fluid amplifier 55. Accordingly, use of the outer fluid amplifier resulted in planing approximately 5.2% faster than the boat with use of the prop guard without the external fluid amplifier 55. The boat equipped with the prop guard with external fluid amplifier 55 also had a higher top speed than when the boat was equipped with the prop guard lacking the external fluid amplifier: 35.40 miles per hour (mph) as opposed to 34.50 mph, a 2.5% improvement.

Additionally, the prop guard with the outer fluid amplifier had greatly improved handling. It was found that the boat could go essentially indefinitely without requiring that the boat's user hold on to the steering wheel or provide corrective steering inputs. The boat remained very stable at speed.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

The invention claimed is:

1. A propeller guard useful in combination with a boat motor, the propeller guard comprising:

an inner circumferential component defining a single band for surrounding a propeller of the motor, the band including an interior surface and an exterior surface and defining a single inlet opening and a single outlet opening, wherein the band includes a plurality of ports formed therein and spaced there around, the plurality of ports allowing fluid flow between the exterior and interior surfaces of the band, wherein the band comprises a convex tapered portion on the interior surface proximate the inlet opening whereby movement of the propeller guard through a fluid such that fluid enters the inlet opening and exits the outlet opening thereof, causes fluid impinging on a convex tapered portion of the interior surface to be diverted along the interior surface and to be accelerated in speed relative to fluid flowing along the exterior surface, thus causing a vacuum effect which draws fluid through the plurality of ports into the band; and an outer fluid amplifier extending from the inner circumferential component and defining a fluid channel extending along a side of the inner circumferential component, wherein the outer fluid amplifier comprises:

a first amplifier member extending from a first point of the band of the inner circumferential component to a second point of the band of the inner circumferential component to define a first fluid channel extending along a first side of the inner circumferential component; and a second amplifier member extending from a third point of the band of the inner circumferential component to a fourth point of the band of the inner circumferential component to define a second fluid channel extending along a second side of the inner circumferential component.

2. The propeller guard according to claim 1, wherein the first amplifier member and the second amplifier member each define an inner surface that is rotated relative to the exterior surface of the band such that the first fluid channel and the second fluid channel are wider proximate the inlet opening and narrower proximate the outlet opening, whereby movement of the propeller guard through a fluid such that fluid enters the first fluid channel and the second fluid channel causes compression of the fluid in the first fluid channel and the second fluid channel, increasing flow of fluid through at least a portion of the plurality of ports having openings located in the first fluid channel or the second fluid channel.

3. The propeller guard according to claim 1, wherein the band of the inner circumferential component comprises a multi-angle shape and wherein the first amplifier member and the second amplifier member each comprise a complementary shape generally conforming to an adjacent portion of the band of the inner circumferential component such that the first fluid channel and the second fluid channel each comprise an elongated narrow channel extending along a side of the inner circumferential component.

4. The propeller guard according to claim 3, wherein the first point of the band and the third point of the band are opposite ends of a first side of the band, and wherein the second point of the band and the fourth point of the band are opposite ends of a second side of the band, the second side of the band and the first side of the band being opposite, substantially parallel sides of the band.

5. The propeller guard according to claim 4, wherein:

a third side of the band between the first point of the band and the second point of the band has an infinite radius and is generally flat;

a section of the first amplifier member most proximate to the third side of the band also has an infinite radius and is generally flat;

a fourth side of the band between the third point of the band and the fourth point of the band has an infinite radius and is generally flat; and a section of the second amplifier member most proximate to the fourth side of the band also has an infinite radius and is generally flat.

6. The propeller guard according to claim 5, wherein:

a fifth side of the band extends between the first side of the band and the third side of the band;

a sixth side of the band extends between the second side of the band and the third side of the band;

a seventh side of the band extends between the first side of the band and the fourth side of the band;

an eighth side of the band extends between the second side of the band and the fourth side of the band;

the fifth, sixth, seventh, and eighth sides of the band have a curved shape;

two sections of the first amplifier member extending proximate the fifth and sixth sides of the band have a curved shape similar to the curved shape of the fifth and sixth sides; and two sections of the second amplifier member extending proximate the seventh and eighth sides of the band have a curved shape similar to the curved shape of the seventh and eighth sides.

7. The propeller guard according to claim 3, wherein:

the band of the inner circumferential component defines an eight-sided shape with generally flat top and bottom sections adapted to be secured to a motor, two generally flat side sections, and four radiused or curved sections, each extending between one of the top or bottom sections to one of the side sections;

the first amplifier member extends from the band proximate an end of the top section of the band to an end on a same side of the bottom section of the band, and the first amplifier member includes two curved sections and a generally flat section each extending alongside corresponding curved and flat sections of the band of the inner circumferential component; and the second amplifier member extends from the band proximate an opposite end of the top section of the band to an end of the bottom section of the band opposite the end intersecting the first amplifier member, and the second amplifier member includes two curved sections and a generally flat section each extending alongside corresponding curved and flat sections of the band of the inner circumferential component.

8. A propeller guard according to claim 7, wherein the sections of the inner circumferential member are of approximately equal size.

9. A propeller guard according to claim 1, wherein the inlet opening and leading edges of the first amplifier member and the second amplifier member are generally planar.

10. A propeller guard according to claim 1, wherein at least one of the inlet opening, a leading edge of the first amplifier member, and a leading edge of the second amplifier member define a sinusoidal shape.

11. A propeller guard useful in combination with a boat motor, the propeller guard comprising:

an inner circumferential component defining a multi-angled band for surrounding a propeller of the motor, the band including an interior surface and an exterior surface and defining an inlet opening and an outlet opening, the band further defining a plurality of sections; and an outer fluid amplifier comprising:

a first amplifier member extending from the inner circumferential component and defining a first fluid channel extending along a first exterior side of the inner circumferential component; and a second amplifier member extending from the inner circumferential component and defining a second fluid channel extending along a second exterior side of the inner circumferential component.

12. The propeller guard according to claim 11 wherein:

the band includes a plurality of ports formed therein and spaced there around, the plurality of ports allowing fluid flow between the exterior and interior surfaces of the band; and the first amplifier member and the second amplifier member each define an inner surface that is rotated relative to the exterior surface of the band such that the first fluid channel and the second fluid channel are wider proximate the inlet opening and narrower proximate the outlet opening, whereby movement of the propeller guard through a fluid such that fluid enters the first fluid channel and the second fluid channel causes compression of the fluid in the first fluid channel and the second fluid channel, increasing flow of fluid through at least a portion of the plurality of ports having openings located in the first fluid channel or the second fluid channel.

13. The propeller guard according to claim 11, wherein the first amplifier member and the second amplifier member each comprise a shape generally conforming to an adjacent portion of the band of the inner circumferential component.

14. The propeller guard according to claim 11, wherein:

the band has eight sections generally defining an eight-sided shape with alternating generally flat and curved sides including a generally flat top side and a generally flat bottom side;

the first amplifier member extends from one end of the top side of the band to one end of the bottom side of the band and is formed with a first curved section, a generally flat section, and a second curved section; and the second amplifier member extends from another end of the top side of the band to another end of the bottom side of the band and is formed with a first curved section, a generally flat section, and a second curved section.

15. A generally octagon-shaped propeller guard for use with a boat motor propeller, the propeller guard comprising:

an inner circumferential component defining a single band sized and configured to surround the propeller and having eight sections being joined at eight joints, the band defining an inlet opening and an outlet opening; and an outer fluid amplifier comprising:

a first amplifier member extending from the inner circumferential component and defining a first fluid channel extending along a first exterior side of the inner circumferential component; and a second amplifier member extending from the inner circumferential component and defining a second fluid channel extending along a second exterior side of the inner circumferential component.

16. The generally octagon-shaped propeller guard according to claim 15 wherein:

the band includes a plurality of ports formed therein and spaced there around, the plurality of ports allowing fluid flow between the exterior and interior surfaces of the band; and the first amplifier member and the second amplifier member each define an inner surface that is rotated relative to the exterior surface of the band such that the first fluid channel and the second fluid channel are wider proximate the inlet opening and narrower proximate the outlet opening, whereby movement of the propeller guard through a fluid such that fluid enters the first fluid channel and the second fluid channel proximate the inlet opening causes compression of the fluid in the first fluid channel and the second fluid channel, increasing flow of fluid through at least a portion of the plurality of ports having openings located in the first fluid channel or the second fluid channel.

17. The generally octagon-shaped propeller guard according to claim 15, wherein the first amplifier member and the second amplifier member each comprise a shape generally conforming to an adjacent portion of the band of the inner circumferential component.

* * * * *